US008660468B2

(12) United States Patent
Matsumoto et al.

(10) Patent No.: US 8,660,468 B2
(45) Date of Patent: Feb. 25, 2014

(54) DEVELOPING DEVICE INCLUDING REFILL OPERATION

(75) Inventors: Keiko Matsumoto, Kanagawa (JP); Makoto Yasuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 456 days.

(21) Appl. No.: 13/019,522

(22) Filed: Feb. 2, 2011

(65) Prior Publication Data

US 2011/0194863 A1 Aug. 11, 2011

(30) Foreign Application Priority Data

Feb. 10, 2010 (JP) ..... 2010-027138

(51) Int. Cl.
*G03G 15/08* (2006.01)

(52) U.S. Cl.
USPC ..... 399/260; 399/262; 399/263

(58) Field of Classification Search
USPC ..... 399/255, 257, 260, 263
See application file for complete search history.

(56) References Cited

U.S. PATENT DOCUMENTS

| | | | | |
|---|---|---|---|---|
| 5,182,600 | A * | 1/1993 | Hasegawa et al. | 399/74 |
| 5,784,669 | A * | 7/1998 | Miura et al. | 399/58 |
| 5,881,334 | A * | 3/1999 | Maruta et al. | 399/18 |
| 5,987,298 | A * | 11/1999 | Muramatsu et al. | 399/359 |
| 6,640,060 | B2 * | 10/2003 | Yamaguchi et al. | 399/27 |
| 7,340,202 | B2 | 3/2008 | Miyamoto et al. | |
| 7,561,831 | B2 * | 7/2009 | Naoi et al. | 399/257 |
| 7,577,377 | B2 | 8/2009 | Miyamoto et al. | |
| 7,801,467 | B2 | 9/2010 | Uno et al. | |
| 8,145,101 | B2 * | 3/2012 | Terai et al. | 399/257 |
| 8,295,737 | B2 * | 10/2012 | Tsuda et al. | 399/254 |
| 2007/0140749 | A1 | 6/2007 | Miyamoto et al. | |
| 2007/0280742 | A1 | 12/2007 | Matsumoto et al. | |
| 2008/0175628 | A1 | 7/2008 | Kita et al. | |
| 2008/0181630 | A1 | 7/2008 | Matsumoto et al. | |
| 2008/0181670 | A1 | 7/2008 | Tsuda et al. | |
| 2008/0187332 | A1 | 8/2008 | Tsuda et al. | |
| 2008/0279592 | A1 | 11/2008 | Matsumoto et al. | |
| 2008/0310865 | A1 * | 12/2008 | Uno et al. | 399/30 |
| 2009/0016777 | A1 | 1/2009 | Miyamoto et al. | |
| 2009/0041508 | A1 | 2/2009 | Oshikawa et al. | |
| 2009/0103935 | A1 | 4/2009 | Uno et al. | |
| 2009/0110425 | A1 | 4/2009 | Uno et al. | |
| 2009/0263164 | A1 | 10/2009 | Koeda et al. | |
| 2010/0008684 | A1 | 1/2010 | Matsumoto | |

FOREIGN PATENT DOCUMENTS

| | | |
|---|---|---|
| JP | 2-181758 A | 7/1990 |
| JP | 2005-234503 | 9/2005 |

(Continued)

OTHER PUBLICATIONS

Japanese Office Action issued Jul. 30, 2013 in Patent Application No. 2010-027138.

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A developing device is refilled with an initial developer while the developing device and a photoreceptor are maintained within an image forming apparatus in the same state as in an image forming process. When refilling the developing device, a control unit of the image forming apparatus first drives a stirring feed member (screw) to feed the initial developer into the developing device, and then drives a developer carrier (developing roller) and a latent image carrier (photoreceptor) to supply the developer onto the developer carrier.

15 Claims, 13 Drawing Sheets

(56) References Cited

FOREIGN PATENT DOCUMENTS

| | | | |
|---|---|---|---|
| JP | 2006-84892 | | 3/2006 |
| JP | 2008-310220 | A | 12/2008 |
| JP | 2009-122619 | | 6/2009 |
| JP | 2010-20309 | A | 1/2010 |

* cited by examiner

DEVELOPING DEVICE INCLUDING REFILL OPERATION

TECHNICAL FIELD

The present invention generally relates to an electrophotographic image forming apparatus such as a copy machine, a facsimile machine or a printer, and a developing device used therein. More particularly, the invention relates to a technique for supply an initial developer in an image forming apparatus while keeping the developing device and the photoreceptor inside the apparatus and for reducing toner consumption as much as possible without damaging the photoreceptor and the cleaning blade.

BACKGROUND ART

In image forming apparatuses, developers are likely to scatter or fly off due to shaking or inclination during shipping or transportation of the apparatuses. After an image forming apparatus is delivered to and installed in a certain place, a serviceman or the like has to refill the image forming apparatus with initial developer. Also, when replacing old developer with new developer, a service man may collect the old developer from the developing device and refill the developing device with new developer. To facilitate the initial developer refill work, a technique for supplying initial developer from a refill port to the developing device, while keeping the developing device and the photoreceptor inside the image forming apparatus, is proposed. See, for example, JP 2005-234503 A (Patent Document 1). However, with this method, toner particles are easily scattered if the developing roller and the photoreceptor are positioned apart from each other.

Another technique is proposed to place a shutter between the developing roller and the photoreceptor to prevent scattering of toner particles. See, for example, JP 2006-084892 A (Patent Document 2). However, because the shutter is an unwanted component for image reproduction, and because replacement of the developer is not carried out very often, it is desired to eliminate such a component to simplify the structure of the developing device. Still another technique is proposed to refill the developing device with an initial developer while keeping the developing device and the photoreceptor inside the image forming apparatus in the same state as in the image reproducing operation. See, for example, JP 2009-122619 A (Patent Document 3). This method does not require an extra component, such as a shutter, unlike Patent Document 2.

However, in Patent Document 3, upon supplying the initial developer, the developing device starts operating (because the stirring/feeding screw and the developing roller are simultaneously driven), and the photoreceptor is driven when the developer is supplied to the developing roller. The reason why the photoreceptor is driven at this timing is that the photoreceptor may be damaged or scratched unless it is operated during the activation of the developing device. However, if the photoreceptor is driven without supplying toner particles to the cleaning part, the cleaning blade is likely to bend or break.

By supplying toner particles to the cleaning part, friction between the photoreceptor and the cleaning blade is reduced and bending or breakage of the cleaning blade is prevented. If there is no image reproduction or image reproduction only at a low image ratio, a dummy toner belt is generally formed on the photoreceptor for the purpose of supplying toner to the cleaning part. Patent Document 3 also employs this method, and a toner belt is formed simultaneously with driving of the photoreceptor. However, with this method, the photoreceptor is activated although the developer has not been supplied to the entire surface of the developing roller, and the toner belt cannot be formed at the full length along the longitudinal area of the photoreceptor. In this case, the photoreceptor is driven under undesirable conditions with an insufficient amount of toner being supplied to the cleaning part.

In addition, since the time for driving the photoreceptor until the supplying of the initial developer is completed becomes long, the quantity of toner to be supplied to the cleaning part increases.

DISCLOSURE OF INVENTION

In view of the above-described technical problems in the prior art, the inventors of the present invention made a thorough study to achieve a technique for reducing the photoreceptor driving time and preventing bending or breakage of the cleaning blade during the developer resupply operation.

It is an objective of the present invention to provide an image forming apparatus and a developing device used therein, which allows initial developer to be supplied in the developing device, while keeping the developing device and a latent-image carrier (i.e., a photoreceptor) inside the image forming apparatus in the same state as in the image reproduction process, without damaging the photoreceptor or a cleaning blade and reducing unnecessary toner consumption as much as possible.

To achieve the objective, as the first aspect of the invention, an image forming apparatus is provided. The image forming apparatus comprises:

a developing device including a developer feed path, a stirring feed member for stirring and feeding a developer in the developer feed path, and a developer carrier;

a latent image carrier positioned so as to face the developer carrier; and a control unit configured to control a refill operation for refilling the developing device with an initial developer, while maintaining the developing device and the latent image carrier inside the image forming apparatus in a same state as in an image forming process, wherein when refilling the developing device with the initial developer, the control unit first drives the stirring feed member to feed the initial developer into the developing device, and then drives the developer carrier and the latent image carrier to supply the developer onto the developer carrier.

As the second aspect of the invention, the control unit of the above-described image forming apparatus controls the refill operation such that the feeding of the initial developer into the developing device is finished before the developer carrier and the latent image carrier are driven.

As the third aspect of the invention, in the above-described image forming apparatus, the latent image carrier is driven after the developer carrier is driven.

As the fourth aspect of the invention, the developing device of the above-described image forming apparatus further has a surplus feed opening for discharging an excessive quantity of the developer from the developer feed path depending on a level of the developer in the developer feed path, and the control unit controls the refill operation so as not to discharge the developer during the refill operation.

As the fifth aspect of the invention, the developing device of the above-described image forming apparatus further has a discharge feed path for transferring the discharged surplus developer out of the developing device and a discharge feed member, and the control unit does not drive the discharge feed member during the refill operation.

As the sixth aspect of the invention, the developing device of the above-described image forming apparatus further has a discharge feed path for transferring the discharged surplus developer out of the developing device and a discharge feed member, and the control unit drives the discharge feed member in a reverse direction to that in an image forming process.

As the seventh aspect of the invention, a developing device used in any one of the aspects of the above described image forming apparatus is provided. This developing device has a surplus outlet port for discharging an excessive quantity of developer depending on a level of the developer in the developer feed path.

DETAILED DESCRIPTION OF THE EMBODIMENTS

The preferred embodiments of the present invention will now be described below in conjunction with the attached drawings, exemplifying a tandem-type color laser copy machine with parallel-arranged multiple photoreceptors (hereinafter, referred to simply as "copy machine") as an image forming apparatus to which the present invention is applied.

<Overall Structure and Function of Image Forming Apparatus>

Figure 1:
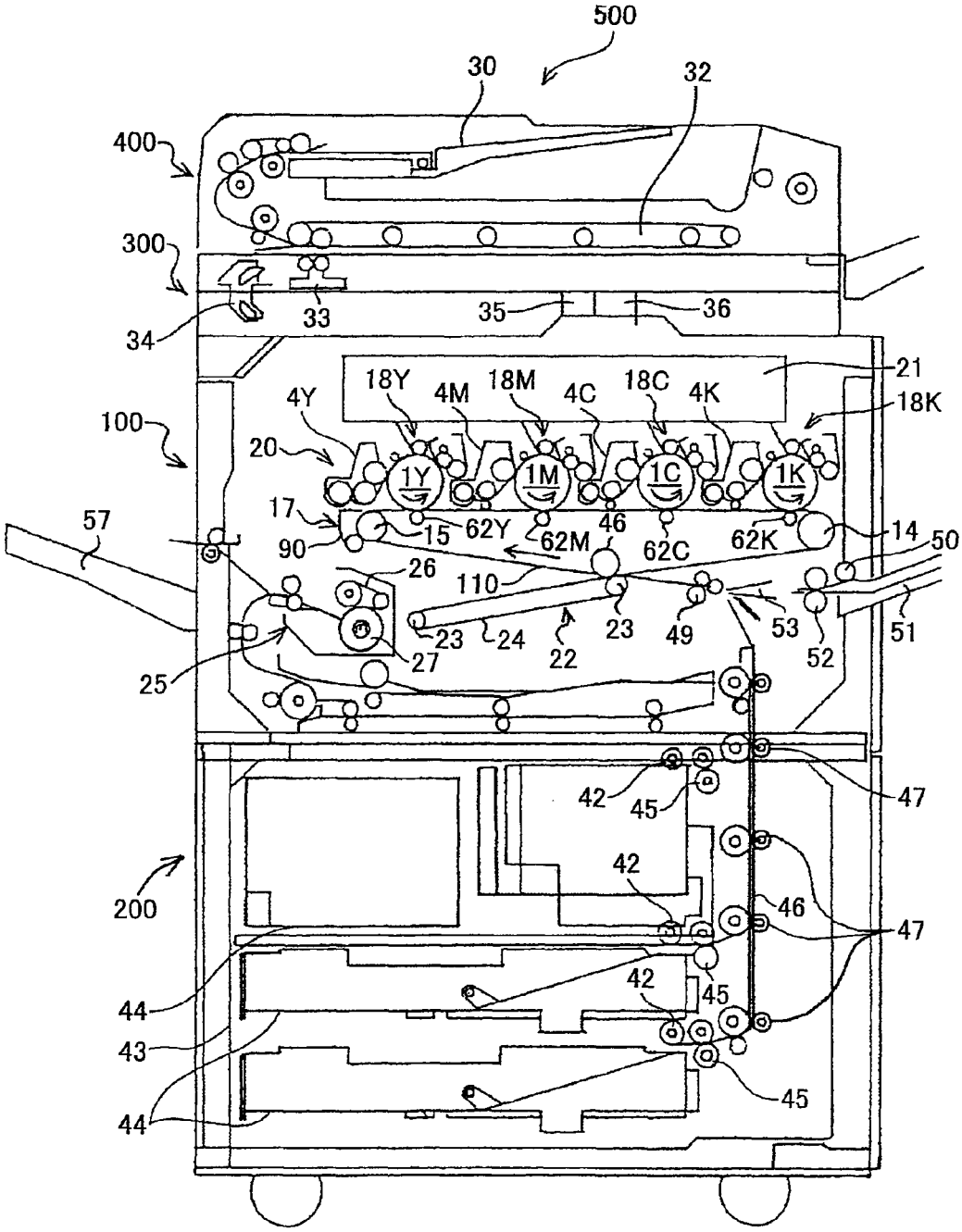
FIG. 1 is a schematic cross-sectional view showing the overall structure of a copying machine to which embodiments of the present invention is applied.

FIG. 1 illustrates a copy machine 500, which includes a printer part 100, a paper feed unit 200 on which the printer 100 is positioned, a scanner 300 fixed onto the printer 100, and an automatic document feeder 400 fixed onto the scanner 300.

The printer part 100 includes an image forming unit 20 comprised of four sets of process cartridges 18Y, 18M, 18C and 18K for creating color images of yellow (Y), magenta (M), cyan (C) and black (K), respectively. The symbols Y, M, C, and K added after numerical references indicate that the corresponding components are for use in yellow, magenta, cyan and black colors, respectively. In addition to the process cartridges 18Y, 18M, 18C, and 18K, an optical writing unit 21, an intermediate transfer unit 17, secondary transfer device 22, a pair of resist rollers 49, and a belt-type fixing device 25 are arranged in the printer part 100.

Although not shown in the figure, the optical writing unit 21 has a light source, a polygon mirror, an f-θ lens, and a reflective mirror to guide a laser beam onto the surface of the photoreceptor (details of which are described below) based upon image data. Each of the process cartridges 18Y, 18M, 18C and 18K includes a drum-shaped photoreceptor 1, an electric charger, a developing device 4, a drum cleaning device, and a neutralization device.

In the description below, explanation is made of a process cartridge 18Y for yellow images. The surface of the photoreceptor 1Y is electrically charged uniformly by the electric charger. The electrically charged surface of the photoreceptor 1Y is irradiated by a modulated and deflected laser beam. The electric potential of the irradiated (exposed) area of the photoreceptor 1Y is attenuated. Due to the attenuation of the electric potential, an electrostatic latent image for yellow color is formed on the surface of the photoreceptor 1Y. The electrostatic latent image for yellow is developed by the developing device 4Y and turns into a yellow (Y) toner image.

The Y toner image formed on the yellow photoreceptor 1Y is primarily transferred onto the intermediate transfer belt 110. After the primary transfer of the toner image, the surface of the photoreceptor 1Y is cleaned by the drum cleaning device to remove residual toner. The cleaned photoreceptor 1Y is then neutralized by the neutralization device in the yellow process cartridge 18Y. The photoreceptor 1Y is again electrically charged uniformly by the electric charger and returns to the initial state. The above-described process applies to the other colors of process cartridges 18M, 18C and 18K.

Next, explanation is made to the intermediate transfer unit 17. The intermediate transfer unit 17 includes an intermediate transfer belt 110 and a belt cleaning device 90. The intermediate transfer unit 17 also includes a tension roller 14, a driving roller 15, a secondary transfer backup roller 16, and four primary transfer bias rollers 62Y, 62M, 62C and 62K.

The intermediate transfer belt 110 is tensioned by multiple rollers including the tension roller 14, and driven endlessly in a clockwise direction by the rotation of the driving roller 15 which is driven by a belt driving motor (not shown). The four primary transfer bias rollers 62Y, 62M, 62C and 62K are positioned so as to be in contact with the inner circumference of the intermediate transfer belt 110, and receive a primary transfer bias voltage from a power source (not shown). Each of the primary transfer bias rollers 62Y, 62M, 62C and 62K presses the intermediate transfer belt 110 from the inner circumference against the corresponding one of the photoreceptors 1Y, 1M, 1C and 1K to structure a primary transfer nip. At each of the primary transfer nips, primary transfer electric field is produced between the photoreceptor 1 and the corresponding primary transfer bias roller 62 due to the application of the primary transfer bias voltage.

The yellow toner image formed on the Y photoreceptor 1Y is transferred onto the intermediate transfer belt 110 under the influence of the primary transfer electric field and the nip pressure. The, a magenta toner image, a cyan toner image and a black toner image formed on the photoreceptors 1M, 1C and 1K, respectively, are successively superimposed over the yellow toner image on the intermediate transfer belt 100 by the primary transfer process. As a result, a multiplexed toner image, that is, a superimposed four-color toner image (hereinafter, referred to simply as a "four-color toner image" occasionally) is formed on the intermediate transfer belt 110. The superimposed four-color image on the intermediate transfer belt 110 is then secondarily transferred onto a transfer paper used as a recording medium (not shown) by means of a secondary transfer nip. The secondary transfer nip will be described below. The residual toners that remain on the intermediate transfer belt 110 having passed through the secondary transfer nip is removed by the belt cleaning device 90. The belt cleaning device 90 and the driving roller 15 (illustrated on the left-hand side of the figure) hold the belt between them.

Next, explanation is made to the secondary transfer device 22. The secondary transfer device 22 is positioned below the intermediate transfer unit 17 in the figure. The secondary transfer belt 22 includes a paper feed belt 24 tensioned between two tension rollers 23. The paper feed belt 24 is endlessly driven in a counterclockwise direction by means of the rotation of at least one of the two tension rollers 23. Between the tension roller 23 of the right-hand side in the figure and the secondary transfer backup roller 16 of the intermediate transfer unit 17 are held the intermediate transfer belt 110 and the paper feed belt 24. This arrangement constitutes a secondary transfer nip at which the intermediate transfer belt 110 of the intermediate transfer unit 17 and the paper feed belt 24 of the secondary transfer device 22 come into contact with each other. A secondary transfer bias voltage with a reverse polarity to that of the toner is applied to the right-hand side tension roller 23 from a power source (not shown). Under the application of the secondary transfer bias voltage, a secondary transfer electric field is produced in the secondary transfer nip to electrostatically transfer the four-color toner image from the intermediate transfer belt 110 of the intermediate transfer unit 17 toward the right-hand side tension roller 23. A transfer paper is fed into the secondary transfer nip by the resist roller pair 49 (which is described below) synchronized with the four-color toner image on the intermediate transfer belt 110, and the four-color toner image is secondarily transferred onto the transfer paper under the influence of the secondary transfer electric field and the secondary transfer nip pressure. In place of the application of the secondary transfer bias voltage to one of the tension rollers 23 (which is referred to as a secondary transfer method), an electric charger may be used to charge the transfer paper in a contactless fashion.

The paper feed unit 200 positioned at the bottom of the copy machine 500 includes paper cassettes 44 stacked in the vertical direction and accommodating stacks of transfer paper. At each of the paper cassettes 44, a paper feed roller 42 is pressed against the top face of the paper stack. By rotating the paper feed roller 42, the uppermost transfer paper is fed to a paper feed path 46.

The paper feed path 46 includes multiple pairs of transport rollers 47 and the pair of resist rollers 49 positioned near the end of the paper feed path 46. The transfer paper is fed along the path to the pair of resist rollers 49 and nipped by the pair of rollers 49. On the other hand, the four-color toner image formed on the intermediate transfer belt 110 of the intermediate transfer unit 17 comes into the secondary transfer nip along with the endless motion of the belt 110. The resist roller pair 49 sends out the transfer paper nipped between the two rollers such that the transfer paper comes into close contact with the four-color toner image at the secondary nip. The four-color toner image on the intermediate transfer belt 110 is electrically attached to the transfer paper at the secondary transfer nip. Thus, the toner image is secondarily transferred to become a full-color image onto the transfer paper. The transfer paper on which the full-color image is produced is on the way out of the secondary transfer nip according to the endless motion of the paper feed belt 24, and reaches the fixing device 25 from the paper feed belt 24.

The fixing device 25 includes a belt unit that endlessly drives a fixing belt 26 tensioned between two rollers, and a pressure roller 27 pressed against one of the two rollers of the belt unit. The fixing belt 26 and the pressure roller 27 are pressed against each other, and define a fixing nip to receive the transfer paper fed from the paper feed belt 24. The roller pressed by the pressure roller 27 has a heat source (not shown) inside to heat the fixing belt 26. The fixing belt 26 having received the heat then heats the transfer paper held by the fixing nip. Due to the heat and the nip pressure, the full-color image is fixed onto the transfer paper.

The transfer paper having been subjected to the fixing process in the fixing device 25 is stacked on a stack tray 57, or alternatively fed back to the secondary transfer nip to form a toner image on the other side of the paper.

To make a photocopy of documents (not shown), a set of documents is set on a platen 30 of the automatic document feeder 400. If the documents are bound like a book, the documents are set on a contact glass 32. Prior to setting the documents, the automatic document feeder 400 is opened with respect to the copy machine 500 to expose the contact glass 32. After the documents are set, the automatic document feeder 400 is closed to press the bound documents.

When the documents have been set, the copy start switch (not shown) is pressed and the scanner 300 starts a reading operation. If a set of documents is set in the automatic document feeder 400, the automatic document feeder 400 feeds a sheet of document onto the contact glass 32 prior to the reading operation. During the reading operation, a first carriage 33 and a second carriage 34 start running, and a light beam is emitted to the document from a light source provided to the first carriage 33. The reflected light from the document is reflected by a mirror provided in the second carriage 34, guided through an imaging lens 35 and made incident on a read sensor 36. The read sensor 36 structures image information based upon the incident light.

Concurrently with the document reading operation, the devices in the process cartridges 18Y, 18M, 18C and 18K, the intermediate transfer unit 17, the secondary transfer device 22, and the fixing device 25 also start operations. The optical writing unit 21 is controlled and driven based upon the image information to form Y, M, C and K toner images on the photoreceptors 1Y, 1M, 1C and 1K, respectively. These toner images are superposed onto the intermediate transfer belt 110 to form a four-color toner image.

Simultaneously with the start of the document reading operation, a paper feed operation starts in the paper feed unit 200. One of the paper feed rollers 42 is selectively rotated and transfer paper is fed out of the corresponding one of the paper cassettes 44 stacked in a paper bank 43. The transfer paper is separated into a sheet of paper by a separation roller 45, sent out to the paper feed path 46, and fed by the pair of transfer rollers 47 toward the secondary transfer nip. In place of the paper feed from the paper cassette 44, a manual feed tray 51 may be used. In this case, a manual feed roller 50 is selected and rotated to feed the transfer paper from the manual feed tray 51. A separation roller 52 separates a sheet of paper from the transfer paper to send out the sheet to a manual paper feed path 53 of the printer part 100.

When forming a multicolor image using two or more toners in the copy machine 500, the intermediate transfer belt 110 is tension such that the upper tensioned surface becomes substantially horizontal, and the photoreceptors 1Y, 1M, 1C and 1K are in contact with the upper tensioned surface of the belt 110. In contrast, when forming a black and white image, the intermediate transfer belt 110 is inclined toward the bottom left of the figure by a mechanism (not shown) so as to separate the upper tensioned surface from the photoreceptors 1Y, 1M and 1C for yellow, magenta and cyan colors. Only the photoreceptor 1K is rotated in a counterclockwise direction to form a black toner image. For the Y, M and C parts, not only the photoreceptors 1, but also the operations of the developing devices 4 are suspended to prevent wear of the components and unnecessary consumption of the developers in the developing devices 4.

The copy machine 500 has a control unit (not shown) including a CPU for controlling the respective devices of the copy machine 500, and a operations display panel (not shown) including a liquid crystal display and various key buttons. A user enters a command to the control unit through key inputs on the operations display panel to select one of three modes for simplex printing (on one side of sheet). The three modes are the direct ejection mode, the inverse ejection mode, and the inverse decal ejection mode.

<Structure of Developing Device>

Figure 2:
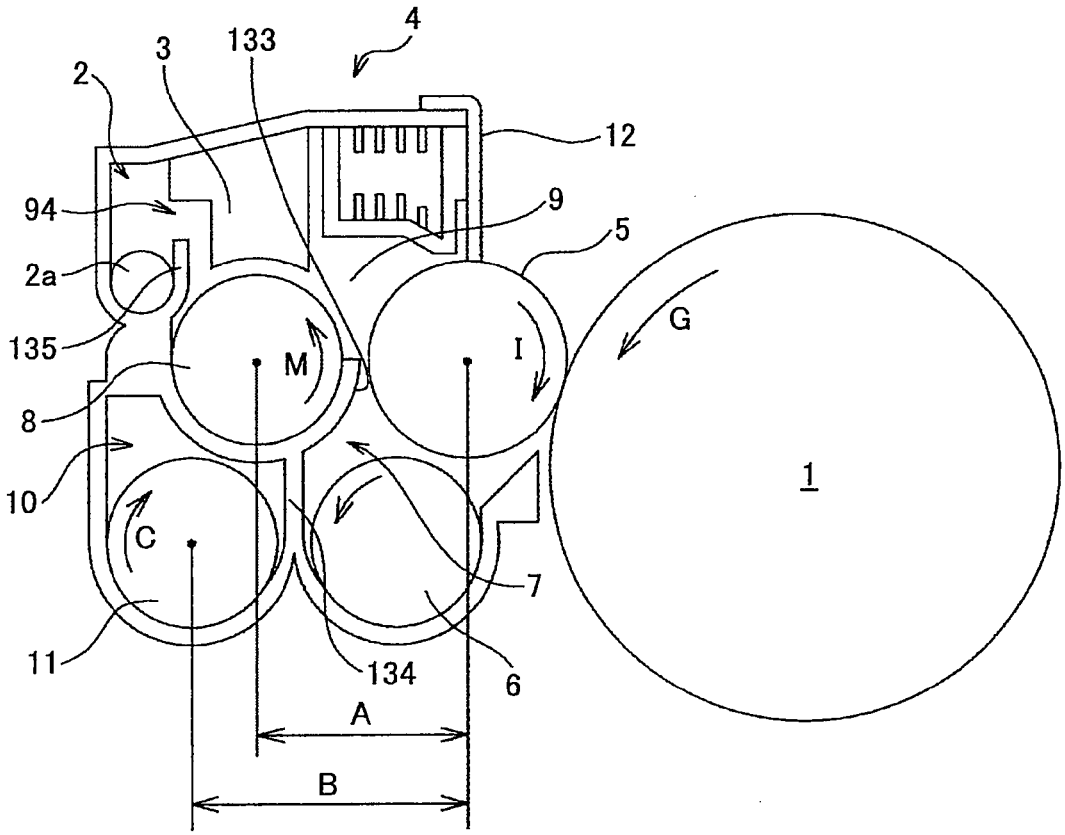
FIG. 2 is an enlarged view of a photoreceptor and a developing device having one of four process cartridges.
Figure 3:
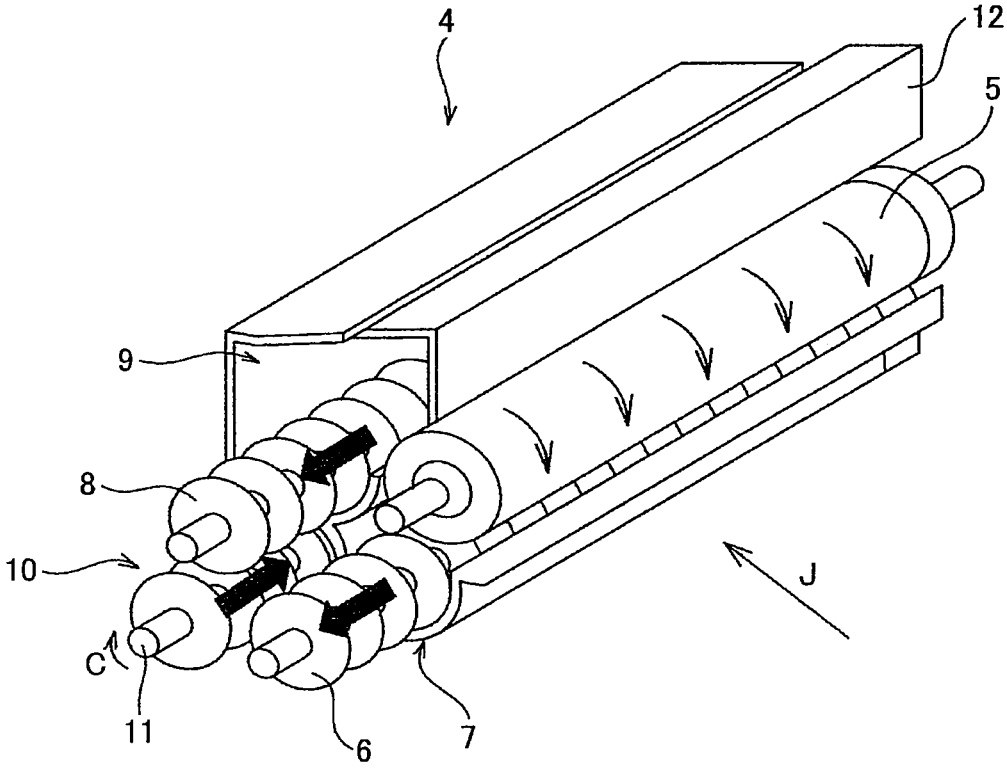
FIG. 3 is a perspective view of the developing device with the flow of the developer indicated by the darkened arrows along the developer feed path.

FIG. 2 illustrates a developing device 4 and the corresponding photoreceptor 1. The four process cartridges 18Y, 18M, 18C and 18K shown in FIG. 1 have substantially the same structure, except that the colors of the toner used by the respective cartridges are different. Accordingly, the symbols Y, M, C and K added to the numerical reference "4" are omitted in the developing device shown in FIG. 2. The photoreceptor 1 rotates in the direction G, and its surface is electrically charged by the electric charger (not shown). The charged surface of the photoreceptor 1 is irradiated by a laser beam emitted from an exposure device (not shown), and an electrostatic latent image is formed on the photoreceptor 1. By supplying toner to the latent image from the developing device 4, a toner image is formed on the photoreceptor 1.

The developing device 4 includes a developing roller 5 which serves as a developer carrier to supply toners to the latent image on the surface of the photoreceptor 1, while causing the roller surface to move in the direction I. The developing roller 5 has a rotatable developing sleeve, within which magnetic materials comprised of multiple magnetic poles are arranged. The magnetic materials are necessary to hold the developer on the surface of the developing roller 5. The developing device 4 also has a supply screw 8 which serves as a supply feeding member for feeding the developer in the direction into the figure parallel to the axle of the developing roller 5, while supplying the developer to the developing roller 5. A doctor blade 12 is provided downstream of the face-to-face position in which the developing rollers faces the supply screw 8 in the surface moving direction. The doctor blade 12 regulates the thickness of the developer supplied onto the surface of the developing roller 5 to be an appropriate thickness.

A collecting feed path 7 is positioned so as to face the developing roller 5 at the downstream of the developing area in which the developing roller 5 faces the photoreceptor 1 in the surface moving direction of the developer roller 5. The collecting feed path 7 collects the used developer that has passed through the developing area and is falling from the surface of the developing roller 5. The collecting feed path 7 is furnished with a spiral collecting screw 6 arranged parallel to the axle of the developing roller 5. The collecting screw 6 serves as a collection feeding member for feeding the collected developer in the same direction as the supply screw 8 parallel to the axle of the developing roller 5. A supply feed path 9 provided with the supply screw 8 extends in the lateral direction of the developing roller 5, and the collecting feed path 7 provided with the collecting screw 6 extend under the developing roller 5 so as to be parallel to the developing roller 5. The developer can be dropped from the surface of the developing roller 5 by eliminating the magnetic poles of a part of the magnetic materials arranged at selected positions inside the developing sleeve (not shown). Alternatively, magnetic materials with the magnetic poles producing a magnetic field of a repulsive force may be used in the area for dropping the developer.

In the developing device 4, a stirring feed path 10 extends under the supply feed path 9 so as to be parallel to the collecting feed path 7. The stirring feed path 10 is furnished with a spiral stirring screw 11 arranged parallel to the axle of the developing roller 5. The stirring screw 11 serves as a stirrer feeding member for feeding the developer in the direction out of the figure (in the reverse direction to that of the supply screw 8) parallel to the axle of the developing roller 5, while stirring the developer.

The supply feed path 9 and the stirring feed path 10 are partitioned by a first partition 133. Both ends of the first partition 133 (out of the figure and into the figure) separating the supply feed path 9 and the stirring feed path 10 are open, and the supply feed path 9 and stirring feed path 10 are in communication with each other. The supply feed path 9 and the collecting feed path 7 are also partitioned by the first partition 133; however, there is no opening provided in the first partition 133 at a position for separating the supply feed path 9 and the collecting feed path 7. The stirring feed path 10 and the collecting feed path 7 are partitioned by a second partition 134. The front side (in the direction out of the figure) of the second partition 134 is open, at which the stirring feed path 10 is in communication with the collecting feed path 7.

The supply screw 8, the collecting screw 6, and the stirring screw 11 serving as developer feeding members are made of a resin or a metal. The diameter of these screws is 22 mm. The supply screw 8 is double corded and has a screw pitch of 50 mm. The collecting screw 6 and the stirring screw 11 are single corded and have a screw pitch of 25 mm. The rotational speed of revolutions of the three screws is about 600 rpm.

A layer of developer carried on the developing roller 5 and thinned by the stainless doctor blade 12 is fed to the developing area at which the developing roller 5 faces the photoreceptor 1 to develop the latent image. The surface of the developing roller 5 is V-grooved or sandblasted, and formed as an aluminum or SUS tube with a diameter of 25 mm. The gap between the doctor blade 12 and the photoreceptor 1 is about 0.3 mm. The used developer after the development is collected in the collecting feed path 7, fed toward the front end of the cross-section of FIG. 2 (in the direction out of the figure), and further fed to the stirring feed path 10 from the opening formed in the first partition 133 at the non-image-forming area. Toner particles are supplied to the stirring feed path 10 from the toner supply port 95 (see FIG. 7, which is described below) provided above the stirring feed path 10 and near the opening of the first partition 133 located upstream of the stirring feed path 10 in the developer feeding direction.

<Circulating Feed Path of Developer>

Next, explanation is made of circulation of the developer in the three developer feed paths. The supply feed path 9, which has received the developer from the stirring feed path 10, feeds the developer to the downstream of the feeding direction of the supply screw 8, while supplying the developer to the developing roller 5. The excessive quantity of toner supplied to the developing roller 5 but not used for development is fed to the downstream of the supply feed path 9, and further fed to the stirring feed path 10 from a surplus feed opening 92 of the first partition 133 (as indicated by the white arrow E in FIG. 4).

On the other hand, the developer supplied to the developing roller 5 is used for development in the developing area, then dropped from the developing roller 5 and collected in the collecting feed path 7. The collected developer is fed by the collecting screw 6 to the downstream of the collecting feed path 7, and further fed to the stirring feed path 10 from a collection opening 93 of the second partition 134 (as indicated by the white arrow F in FIG. 4). The stirring feed path 10 stirs the surplus developer and the collected developer, and feeds the stirred developer to the downstream of the feeding direction of the stirring screw 11, which corresponds to the upstream of the feeding direction of the supply screw 8. The stirred developer is supplied to the supply feed path 9 from a supply opening 91 of the first partition 133 (as indicated by the while arrow D in FIG. 4).

In the stirring feed path 10, the collected developer, the surplus developer, and toner particles supplied as necessary from a supply unit are stirred by the stirring screw 11 and fed in the direction reverse to that in the collecting feed path 7 and the supply feed path 9. The stirred developer is fed to the upstream of the feeding direction of the supply feed path 9 which is connected via the supply opening 91 to the downstream of the stirring feed path 10. A toner concentration sensor (not shown) comprised of a permeability sensor is provided below the stirring feed path 10. The sensor output activates a toner supply control unit (not shown) to cause toner supplied from a toner container (not shown). The permeability sensor senses the magnetic characteristics of the magnetic carriers contained in the developer existing in the sensing area and outputs the result as electric signals. The output level of the permeability sensor monotonically decreases as the amount of magnetic carriers in the sensing area increase within the practical range of the toner concentration. Accordingly, the toner concentration of the developer can be detected based upon the output level of the sensor.

Figure 4:
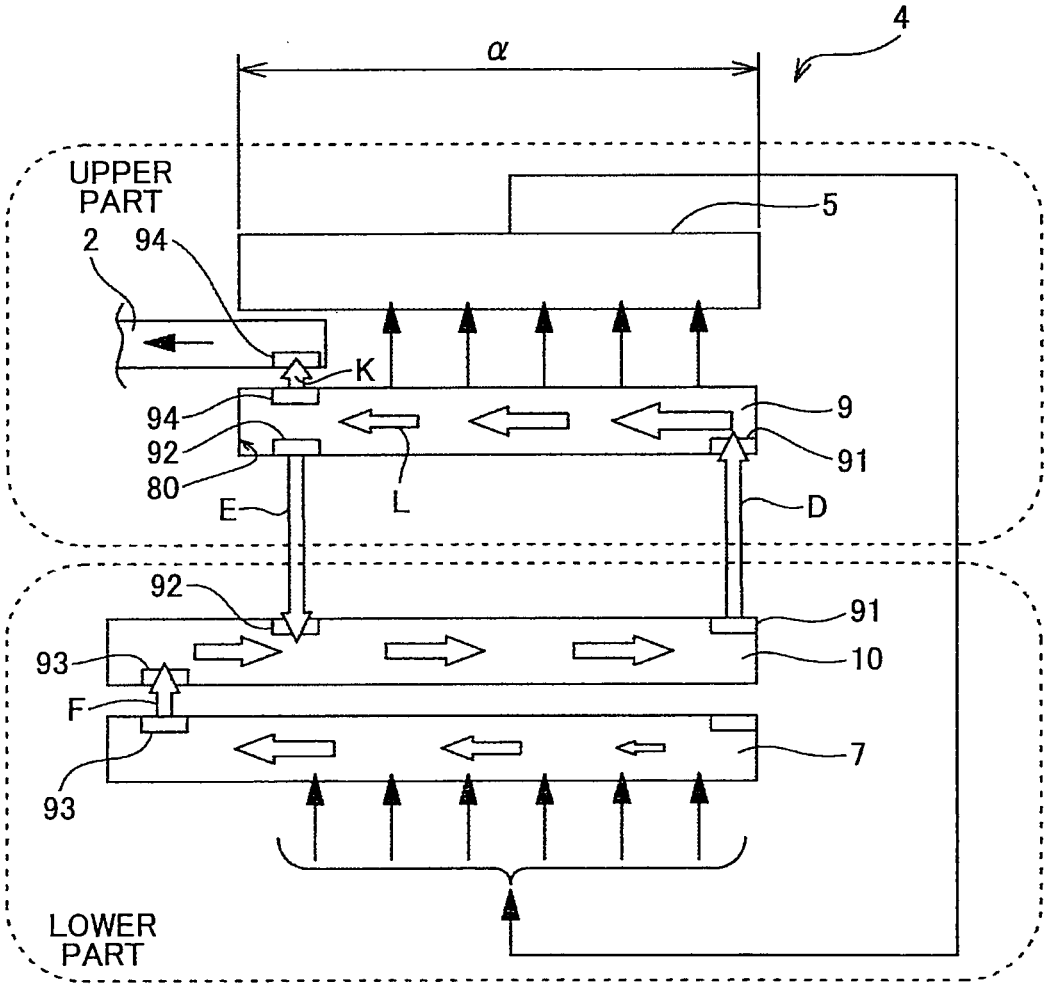
FIG. 4 is a schematic diagram for explaining the flow of the developer in the developing device, indicated by white arrows.

Since the developing device 4 shown in FIG. 4 is furnished with the supply feed path 9 and the collecting feed path 7 to supply and collect developer in separate paths, used developer is prevented from mixing into the supply feed path 9. This arrangement can also prevent the toner concentration of the developer supplied to the developing roller 5 from decreasing as the developer moves ahead to the downstream along the supply feed path 9. In addition, since the collecting feed path 7 and the stirring feed path 10 are provided in the developing device 4 to carry out collection and stirring of the developer in separate paths, used developer is prevented from mixing into the stirring feed path 10. With this arrangement, sufficiently stirred developer is supplied to the supply feed path 9, avoiding the situation where insufficiently stirred developer is supplied to the supply feed path 9. Consequently, the image density can be maintained constant during the development because decrease of the toner concentration and insufficiently stirring of the supplied developer are prevented.

As illustrated in FIG. 4, upward transfer of the developer in the developing device 4 occurs only at a position indicated by the arrow D. In general, upward transfer of developer as indicated by the arrow D is performed by thrusting the developer toward the downstream of the stirring feed path 10 by means of the rotation of the stirring screw 11 so as to push the developer into the supply feed path 9. This method gives stress to the developer and it becomes one of the factors to shorten the service lifetime of the developer. Accordingly, it is desirable to avoid upward transfer of the developer as much as possible.

The stress applied to the developer by upward transfer of the developer may cause abrasion of the carrier film contained in the developer and exhaustion of the toner, and stability of the image quality is degraded. To overcome this problem, stress applied to the developer due to upward transfer is reduced as much as possible in this embodiment to maintain the serving lifetime of the developer. Thus, a developing device that can reduce unevenness in the image density and achieve a stable image quality can be realized, while preventing degradation of the developer.

In the developing device 4, the supply feed path 9 is located obliquely above the stirring feed path 10, as illustrated in FIG. 2. This arrangement can reduce stress on the developer fed in the direction D (FIG. 4), as compared to an arrangement with the supply feed path 9 positioned vertically above the stirring feed path 10. In addition, by arranging the supply feed path 9 and the stirring feed path 10 in the oblique positional relationship, the upper wall of the stirring feed path 10 is located higher than the lower part wall of the supply feed path 9, as illustrated in FIG. 2. Arranging the supply feed path 9 vertically above the stirring feed path 10 requires the developer to be lifted against gravity by means of the pressure of the stirring screw 11, which arrangement applies stress on the developer. In contrast, by positioning the upper wall of the stirring feed path 10 higher than the lower part wall of the supply feed path 9, the developer existing at the highest point of the stirring feed path 10 can flow into the lowest point of the supply feed path 9 without resistance of gravity. Accordingly, stress on the developer is reduced. A fin member may be provided to the shaft of the stirring screw 11 at a position where the stirring feed path 10 is in communication with the supply feed path 9 at the downstream of the stirring feed path 10. The fin member includes, for example, a plate extending parallel to the axle of the stirring screw 11 and a plate extending perpendicular to the axle of the stirring screw 11. By stirring the developer with the fin member, the developer can be fed more efficiently from the stirring feed path 10 to the supply feed path 9.

As illustrated FIG. 2, the supply feed path 9 and the stirring feed path 10 are arranged in the developing device 4 such that the distance A between the centers of the developing roller 5 and the supply feed path 9 is less than the distance B between the centers of the developing roller 5 and the stirring feed path 10. This arrangement allows the developer to be supplied naturally from the supply feed path 9 to the developing roller 5, and the device can be made compact. The stirring screw 11 rotates in the clockwise direction (in the direction C) in FIG. 2. The developer is lifted up along the shape of the stirring screw 11 and fed into the supply feed path 9. Since the developer is effectively lifted up, stress on the developer can be reduced.

Figure 5:
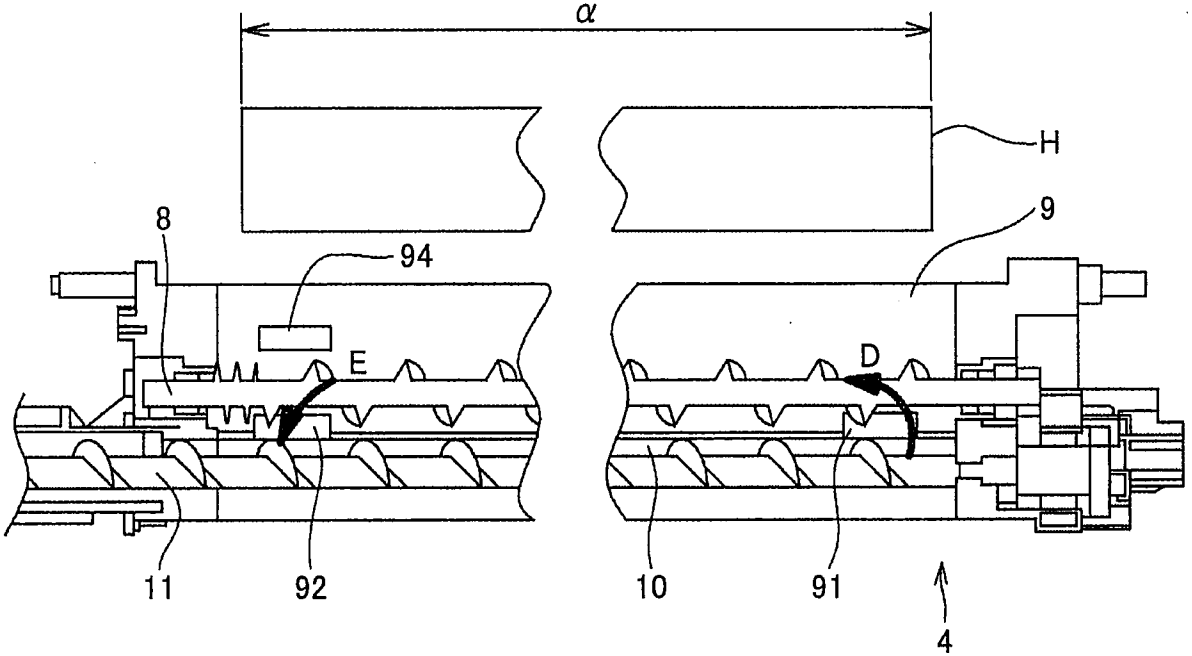
FIG. 5 is a cross-sectional view of the rotation center of the feeding screw of the developing device seen from direction J.

FIG. 5 illustrates a developing area in which the developing roller 5, which serves as a developer carrier, supplies toner particles to the photoreceptor 1, which serves as a latent image carrier. The developing area H has a width $\alpha$ along the rotating shaft of the developing roller 5. Both a supply opening 91 through which the developer is fed upward from the stirring feed path 10 to the supply feed path 9 and a surplus feed opening 92 through which the developer is dropped from the supply feed path 9 to the stirring feed path 10 are provided within the width α of the developing area H.

<Comparative Structure of Developing Device>

Figure 6:
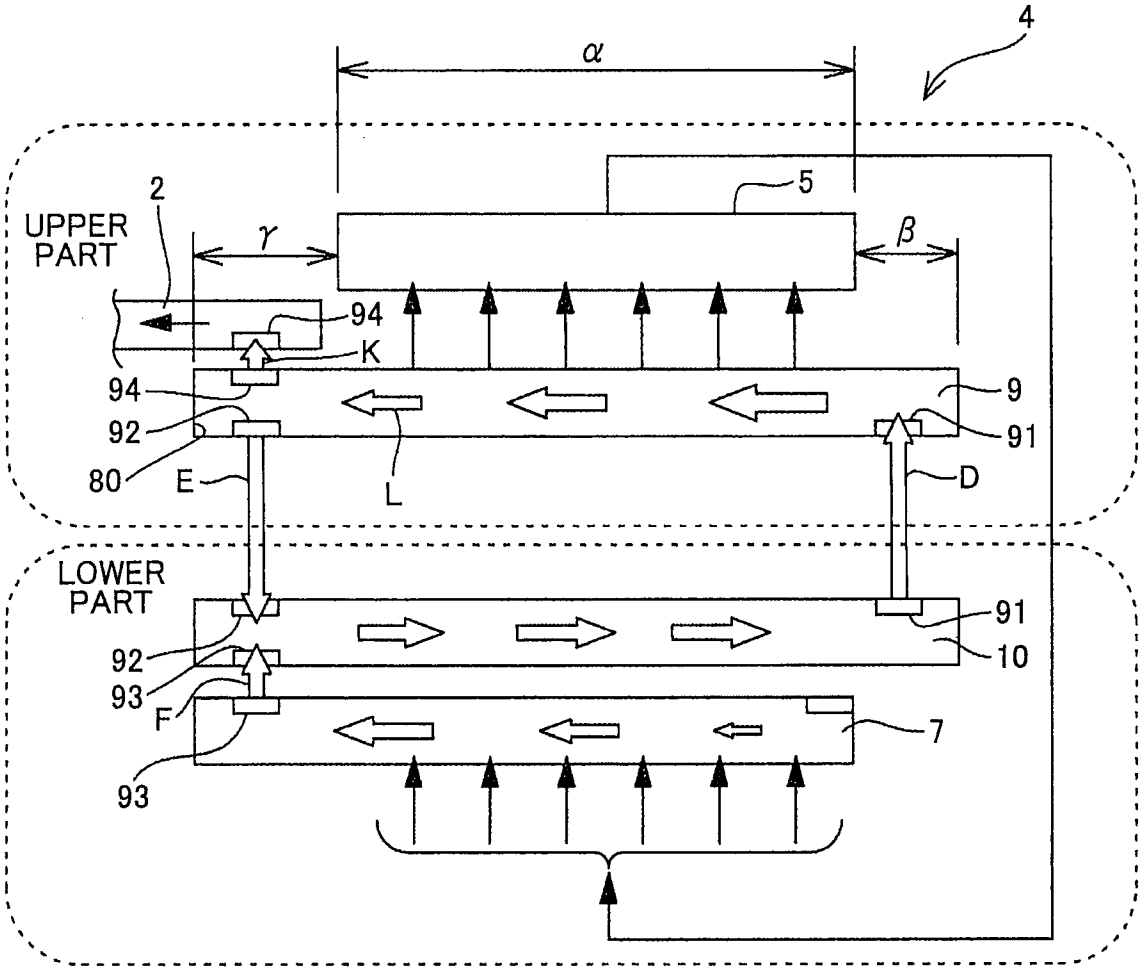
FIG. 6 is a schematic diagram for explaining the flow of the developer in another developing device with a structure different from that shown in FIG. 4.

FIG. 6 illustrates a comparative structure of the developer feed path in a developing device 4, which is different from that shown in FIG. 4. In this developing device, a supply opening 91 and a surplus feed opening 92 are provided outside the width α of the developing area. Because the supply opening 91 is provided outside the width α of the developing area, the upstream end of the supply feed path 9 becomes longer by length β than the developing roller 5. Similarly, due to the position of the surplus feed opening 92 outside the width α of the developing area, the downstream end of the supply feed path 9 becomes longer by length γ than the developing roller 5.

Compared to this structure of FIG. 6, the supply feed path 9 shown in FIG. 4 can be shortened by length β at its upstream because the supply opening 91 is provided within the width α of the developing area. Similarly, the supply feed path 9 shown in FIG. 4 can be shortened by length γ at its downstream end as compared to the structure shown in FIG. 6 because the surplus feed opening 92 is provided within the width α of the developing area. With the arrangement of FIG. 4 in which the supply opening 91 and the surplus feed opening 92 are provided within the width α of the developing area, the upper space of the developing device 4 can be conserved.

<Toner Supply Position>

Next, explanation is made of the toner supply position for supplying toner to the developer feed path of the developing device 4, which path includes the supply feed path 9, the stirring feed path 10 and the collecting feed path 7.

Figure 7:
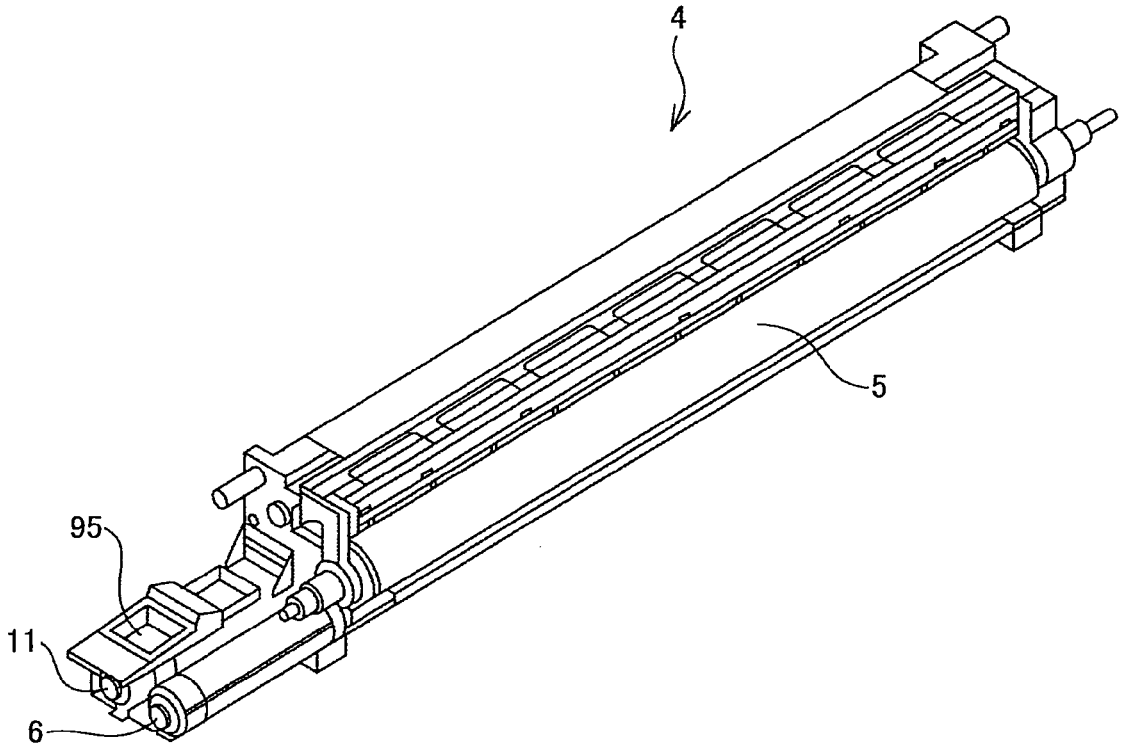
FIG. 7 is a perspective view showing the exterior appearance of the developing device.

FIG. 7 is a perspective view of the developing device 4. As shown in FIG. 7, the toner supply port 95 is provided to the top of the stirring feed path 10 furnished with the stirring screw 11, at its upstream end. The toner supply port 95 is positioned outside the end of the developing roller 5 along the width, which means that it is positioned outside the width α of the developing area. The toner supply port 95 is located at an extension of the supply feed path 9 in the feeding direction and in a vacant space corresponding to the downstream area γ required in the structure shown in FIG. 6. By providing the surplus feed opening 92 within the width α of the developing area, the toner supply port 95 can be placed at the vacant space, thereby making the developing device compact.

The position of the toner supply port 95 is not limited to the top of the upstream end of the stirring feed path 10, it may be provided to the top of the downstream end of the collecting feed path 7. Alternatively, the toner supply port 95 may be positioned directly above the collection opening 93 at which the developer is transferred from the collecting feed path 7 to the stirring feed path 10. The space directly above the collection opening 93 is also located in a vacant space produced by placing the surplus feed opening 92 within the width α of the developing area, and accordingly, the developing device 4 can be made compact with the toner supply port 95 positioned at the vacant space. Supplying toner at this position (directly above the collection opening 93) is also advantageous to effectively mix the toner into the developer because the collection opening 93 functions as a transfer section toward the stirring feed path.

As has already been described above in conjunction with FIG. 4, the supply opening 91 for transferring the developer from the downstream end of the stirring feed path 10 to the upstream end of the supply feed path 9, and the surplus feed opening 92 for transferring the developer from the downstream end of the collecting feed path 7 to the upstream end of the stirring feed path 10 are positioned within the width α of the developing area. Accordingly, the upper space of the developing device 4 can be conserved compared to the conventional developing device, which leads to conservation of the space of the entirety of the developing device. Providing the surplus feed opening 92 within the width α of the developing area allows the toner supply port 95 to be provided in a vacant space, which arrangement also allows the developing device 4 to be made compact. By supplying toner from above the collection opening 93 at which the developer is transferred from the collecting feed path 7 to the stirring feed path 10, the supplied toner can be efficiently mixed in the developer. Using the developing device 4 in the printer part 100 of a copy machine (explained as an example of an image forming apparatus) allows the space inside the entire machine or apparatus to be reduced.

A toner refill control unit (not shown) used as developer supply means supplies toner from a toner container via the toner supply port 95 to the developing device 4. A developer containing toner and a carrier may be supplied from the toner supply port 95. The developer in which toner and a carrier are mixed is hereinafter referred to as "premixed toner".

As illustrated in FIG. 2 and FIG. 4, in the developing device 4, a circulating feed path for transferring surplus developer having reached the downstream end of the supply feed path 9 back to the upper stream end of the supply stream path 9 corresponds to the stirring feed path 10. A circulating transfer member for applying a transfer force to the developer in the stirring feed path 10 corresponds to the stirring screw 11. A circulation opening provided near the downstream end of the supply feed path 9 to allow the developer to pass through and get into the stirring feed path 10 (serving as the circulating feed path) 10 corresponds to the surplus feed opening 92. In the developing device 4, a developer outlet port (surplus outlet port) 94 may be provided to the supply feed path 9 to discharge the developer out of the developing device 4. The developer is discharged from the developer outlet port 94 to the discharging feed path 2 and guided out of the developing device 4 by means of rotation of a discharge screw 2*a* that serves as a discharge feed member. The discharging feed path 2 is provided adjacent to and separated from the supply feed path 9 by an outlet partition 135 at the downstream of the supply feed path 9. The developer outlet port 94 is formed in the outlet partition 135 to connect the supply feed path 9 to the discharging feed path 2. A developer outlet port 94 may be provided in any suitable part, other than the supply feed path 9, as long as the level (or the height) of the surface of the developer surface changes depending on the quantity of developer.

Figure 8:
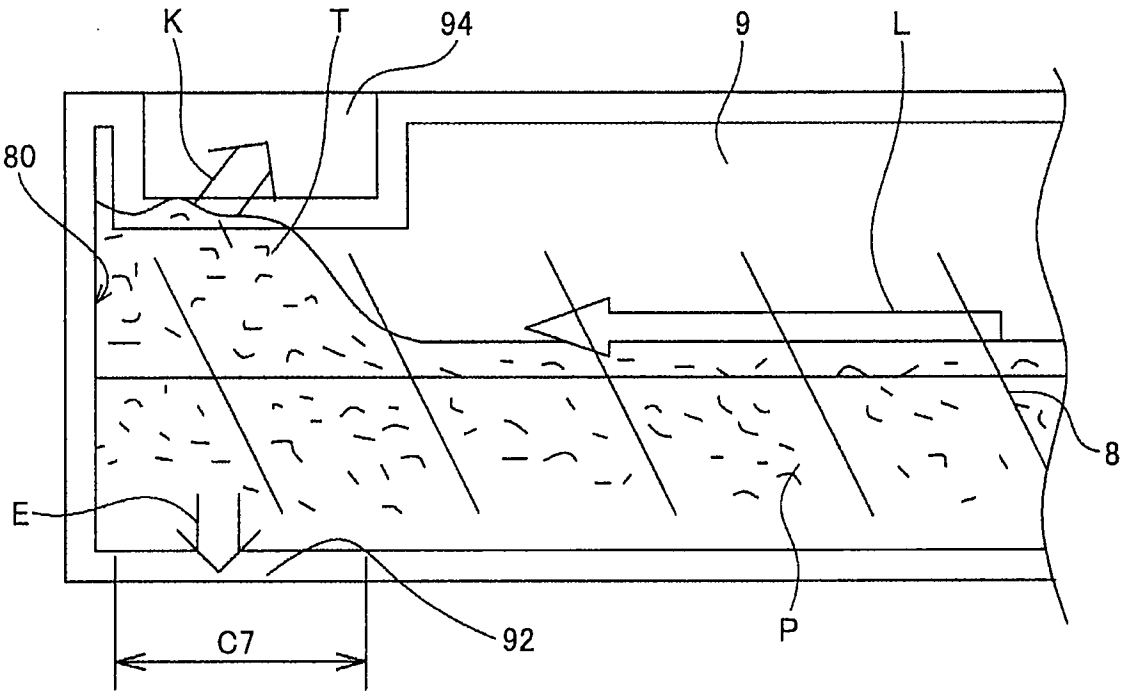
FIG. 8 is an enlarged schematic diagram near the end of the downstream along the supply feed path of the developing apparatus.

FIG. 8 is a schematic diagram illustrating an example of discharging the developer. The developing device 4 has a supply-path downstream end wall 80 which serves as developer accumulating means for accumulating the developer near the developer outlet port 94 positioned in the vicinity of the surplus feed opening 92. The developer outlet port 94 is designed so as to allow a part of the developer accumulated by the supply-path downstream end wall 80 and having reached the level of the developer outlet port 94 above the surplus feed opening 92 to pass through. In other words, an excessive quantity of developer P having reached the downstream end of the supply feed path 9 but overspilled from the surplus feed opening 92 is banked at the supply-path downstream end wall 80 and becomes accumulated developer T. When the level of the surface of the accumulated developer T goes up, the developer having reached the developer outlet port 94 located above the surplus feed opening 92 is discharged from the developing device 4 through the developer outlet port 94, as illustrated by an arrow K.

The quantity of the accumulated developer T varies depending on the quantity of developer fed to the downstream end of the supply feed path 9 (illustrated by the arrow L) and the quantity of developer passing through the surplus feed opening 92 (illustrated by the arrow E). During the operation of the developing device 4, a certain quantity of developer P required for circulation is always fed from the supply feed path 9 through the surplus feed opening 92 to the stirring feed path 10. If the quantity of developer having reached the downstream end of the supply feed path 9 (in the direction L of FIG. 4 and FIG. 8) becomes greater than the quantity of developer transferred from the supply feed path 9 through the surplus feed opening 92 to the stirring feed path 10 (in the direction E of FIG. 4 and FIG. 8), the quantity of the accumulated developer T increases. In the opposite state, the quantity of the accumulated developer T decreases. With the existence of the accumulated developer T, a quantity of developer necessary for circulation is always supplied through the surplus feed opening 92 to the stirring feed path 10 and therefore it will not be in short supply. As long as the accumulated developer T exists, a necessary quantity of developer is supplied from the stirring feed path 10 to the supply feed path 9 because the necessary quantity of developer is fed to the stirring feed path 10. In this state, a necessary quantity of developer is maintained in the developing device 4.

The developer discharged out of the developing device 4 is excessive developer having reached the level of the developer outlet port 94. If the level of the accumulated developer goes below the developer outlet port 94, discharge of the developer stops. The accumulated developer exists in the developing device 4 without discharge, and therefore, a necessary quantity of developer is maintained in the developing device 4.

<Refilling Operation with Developer>

Figure 9:
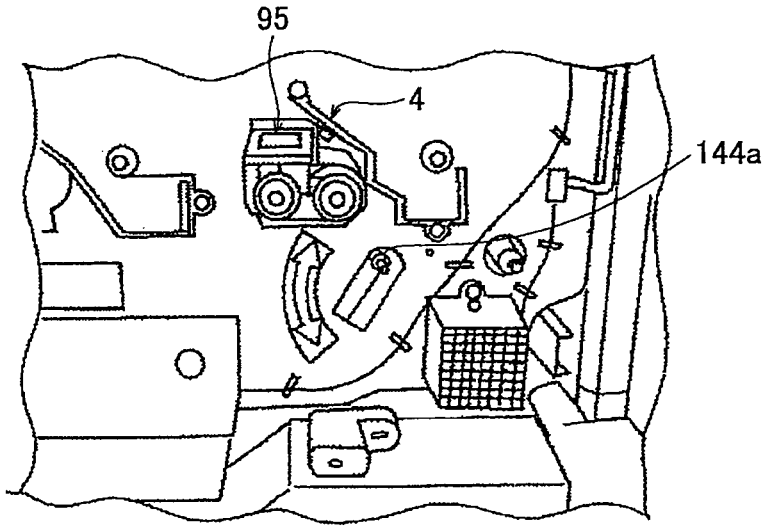
FIG. 9 is an enlarged view of the developing device from which a toner refill device is removed.
Figure 10:
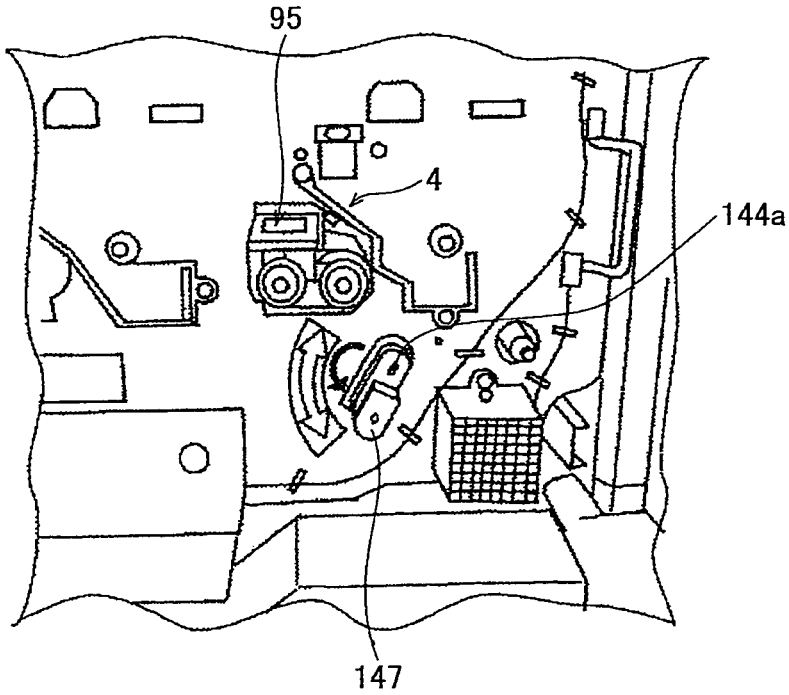
FIG. 10 is a partial view of the developing device of FIG. 9, in which a lever is fixed to the cam shaft of the second contact/noncontact cam.
Figure 11:
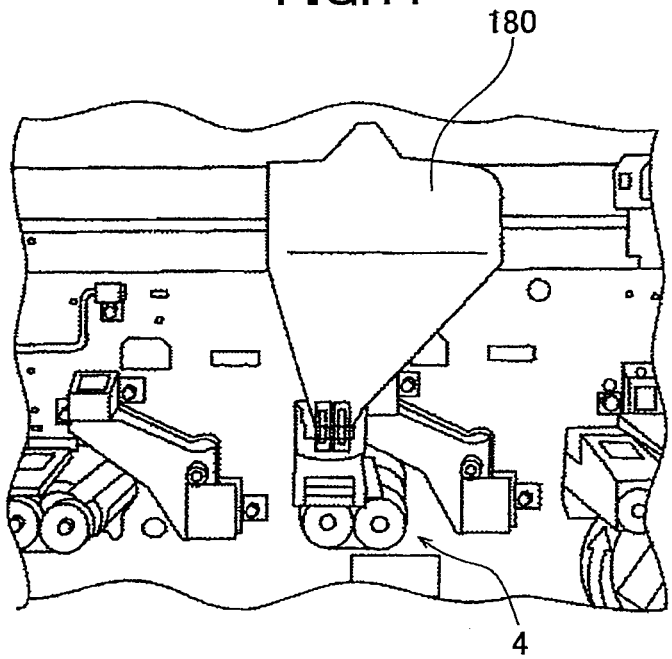
FIG. 11 is a partial view of the developing device, in which a developer bottle is attached to the toner supply port.

In the image forming apparatus of the present embodiment, the developing device 4 is filled with a developer according to the following process. First, the front door of the copy machine 500 is opened, while the main power source is switched off, and the toner refill device 600 (FIG. 12) screwed to the side wall of the apparatus is removed from the main body of the apparatus. By removing the toner refill device 600, the toner supply port 95 of each of the developing devices 4 is exposed, as illustrated in FIG. 9. Then, as illustrated in FIG. 10, a lever 147 is attached to the end of a cam shaft 144*a* of a second contact/non-contact cam to rotate the cam in the counter clockwise direction to separate the intermediate transfer belt 110 from all of the photoreceptors 1Y, 1M, 1C and 1K. Next, as illustrated in FIG. 11, a developer bottle 180 is set in such a manner that a developer supply nozzle 601 (FIG. 12) of the developer bottle 180 is fit into the toner supply port 95. In the initial work carried out when the copy machine 500 is delivered to a user, four colors of developer bottles corresponding to Y, M, C and K are set to the associated toner supply ports.

Figure 12:
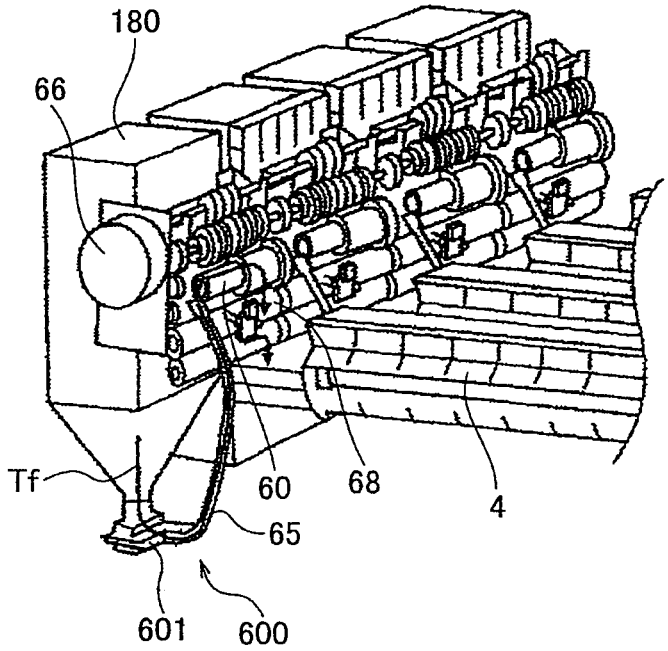
FIG. 12 is a schematic view of a part of the developing device, in which a developer bottle is set.

When replacing developer, old developer is collected from the developing device 4 and the developer bottle 180 is set to the toner supply port 95. Then, a heat-sealing film (not shown) sealing the developer supply nozzle 601 is removed to unseal the developer bottle. Then, the front door of the copy machine 500 is closed and the main power is switched on. Then, a hidden menu is called from an operations panel (not shown) to select a color corresponding to the developer bottle 180 to carry out the refill operation. In the initial work performed when the copy machine 500 is delivered to the user, full-color operation is selected for the refill operation. In FIG. 12, premixed toner is supplied from the developer bottle 180 to the developing device 4 along a toner flow path Tf, using a toner pump 60, a toner refill pump 65, a driving motor 66, and a sub-hopper 68.

When carrying out the refilling process, the stirring feed screw 11 is first driven to feed the initial developer supplied from the developer refill nozzle 601 to the stirring feed path 10. Then, the developing roller 5, which serves as a developer carrier, starts rotating and the initial developer is supplied onto the surface of the developer roller 5. At this time, the photoreceptor 1 may also be rotated simultaneously with the rotation of the developing roller 5, or alternatively, it may be rotated after the developing roller 5 starts rotating. When the photoreceptor 1 starts rotating, a toner belt is formed onto the photoreceptor 1 to supply toner to the cleaning part (unit) in order to prevent undesired damage to or bending of the cleaning blade. When all the initial developer has been transferred to the stirring feed path 10, the driving of the apparatus is stopped to finish the refill operation. If initial developer is still remaining in an initial developer container, all the activated components of the apparatus are continuously driven until the entirety of the initial developer is fed to the stirring feed path 10. Then, the refill operation is finished.

When full-color refilling is selected, a refill operation may be carried out successively for each of the developing devices, or simultaneously for all the developing devices. Alternatively, a refill operation may be carried out for only a selected specific color.

Although in this embodiment, initial developer is supplied from the toner refill port 95 used to supply additional toner, a dedicated port for resupplying the initial developer may be provided. In this embodiment, once a developer bottle 180 is set to the toner supply port 95, toner supply from the bottle is carried out automatically. However, the initial developer may be supplied manually from a gadget bag into the toner supply port 95.

It is desirable for the developing roller 5, which serves as the developer carrier, not to start rotating until a sufficient quantity of developer covers the entire area of the developer feed path, even if a certain quantity of developer is fed to the developer feed path and supplied onto the developing roller 5. It is more preferable for the developing roller 5 to start rotating when substantially all the developer has been loaded into the developing device 4.

By controlling the starting point of the rotation of the developing roller 5, developer can be supplied onto the entire surface of the developing roller 5 immediately after the start of the rotation of the developing roller 5, and a time required for the developing roller 5 to be uniformly covered with the developer can be shortened. If the rotation of the photoreceptor 1 is controlled so as to start simultaneously with the rotation of the developing roller 5, a time required to form a toner belt across the entire area along the longitudinal axis of the photoreceptor 1 is shortened. This arrangement also reduces an undesirable time period in which the photoreceptor 1 is rotating without supplying toner to the cleaning part. If the rotation of the photoreceptor 1 is started after the rotation of the developing roller 5, a time in which the photoreceptor 1 is not activated in spite of the rotation of the developing roller 5 can be shortened.

Determination as to when to start the rotation of the developing roller 5 may be made by detecting the quantity of initial developer using the above-described toner concentration sensor for detecting the toner concentration of the developer during image formation, or independent detection means for detecting the quantity of the initial developer may be provided in the stirring feed path 10. If the developer is automatically supplied, time lapse from the beginning the refill operation may be measured to determine the rotation start timing.

If rotation of the photoreceptor 1 is begun after the developing roller 5 starts rotating, the rotation start timing of the photoreceptor 1 may be determined by means for detecting the quantity of developer attached onto the developing roller 5. Alternatively, a time required to supply the developer uniformly onto the developing roller 5 may be measured in advance, and the rotation start timing of the photoreceptor 1 may be determined from the elapsed time from the start time for driving the developing roller 5.

It is desired that a toner belt be formed on the photoreceptor 1 upon the rotation of the photoreceptor 1 to supply toner to the cleaning part.

If the developer outlet port 94 is provided in the developer feed path, initial developer that has not deteriorated yet may be discharged from the developing device 4. To prevent this, it is desired to maintain the developer in the developing device as much as possible during the refill operation.

To achieve this, one possible method is to start rotating the developing roller 5 before the flow of the initial developer has reached the bottom end of the developer outlet port 94 during the refill operation and supply the developer to the developing roller 5 before the initial developer is discharged. This method needs to detect the quantity of the flow of the developer before it reaches the bottom end of the outlet port 94, and therefore, an extra sensor is required.

To carry out the refill operation without worrying about the discharge of the initial developer, it is desired to provide a shutter to the developer outlet port 94 to close the port. An alternative is to provide a feed path and a feed screw for transferring the developer discharged from the developer outlet port 94. The latter arrangement eliminates the use of extra sensors. In this embodiment, the rotation of the discharge screw 2*a* is controlled such that the rotation is suspended or changed to the reverse direction to that for the image formation process to block the opening making use of a small quantity of discharged developer, thereby preventing a large quantity of initial developer from being discharged.

When all the developer in the developer container has been supplied to the developing device 4, the refill operation is finished and the main power of the apparatus is switched off. Then the front door of the apparatus is opened and the toner refill device 600 is fixed to the main body of the apparatus. The level 147 is rotated and the front door is closed.

FIRST EXAMPLE

The image forming apparatus shown in FIG. 1 is furnished with a developing device which has the same structure as that shown in FIG. 4 except that the developer outlet port 94, the discharge feed path 2 and the discharge screw 2*a* are not provided. The developing device is refilled with initial developer manually from a gadget bag through the toner supply port 95.

Figure 13:
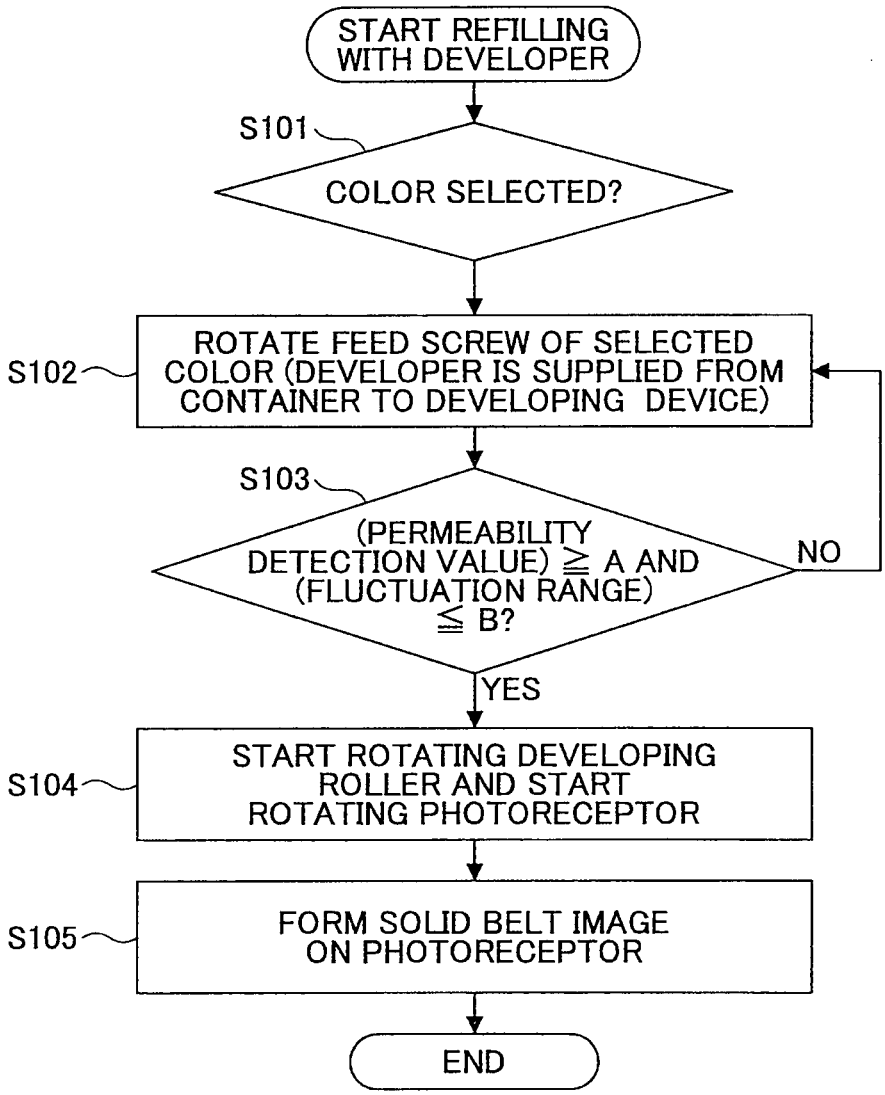
FIG. 13 is a flowchart of refilling the developing device with a developer according to the first embodiment.

FIG. 13 is a flowchart of the refill operation performed in the image forming apparatus of Example 1. Upon start of the refill operation and selection of the color (S101), the stirring feed screw 11 is driven to feed the initial developer supplied form the container to the developer feed path (S102). At the same time, the toner concentration sensor for detecting the permeability starts sensing. If the detected permeability is at or above a predetermined value (A) and if variation in the detected value has converged within a prescribed range (fluctuation range B) in a prescribed time, then it is determined that all the developer has been supplied to the stirring feed path 10 (YES in S103). Then, the developing roller 5 and the photoreceptor 1 are rotated (S104). Upon the start of the rotation of the developing roller 5 and the photoreceptor 1, a toner belt (i.e., a solid belt image) with a constant width is formed on the photoreceptor 1 across the entire area along the longitudinal axis thereof to supply toner to the cleaning part (S105). Then, driving of all the activated components is stopped and the refill operation is finished.

A toner refill device (i.e., a refill unit) 600 is then fixed to this image forming apparatus, and initial developer is set up. Then a full solid image is printed. There was no adverse effect found in the printed image, which means that the refill operation was carried out without damaging the photoreceptor 1 or the cleaning blade.

EXAMPLE 2

The image forming apparatus shown in FIG. 1 is furnished with a developing device shown in FIG. 4 and initial developer is supplied from the bottle automatically upon setting the developer bottle 180 to the toner supply port 95 and unsealing of the bottle 180.

Figure 14:
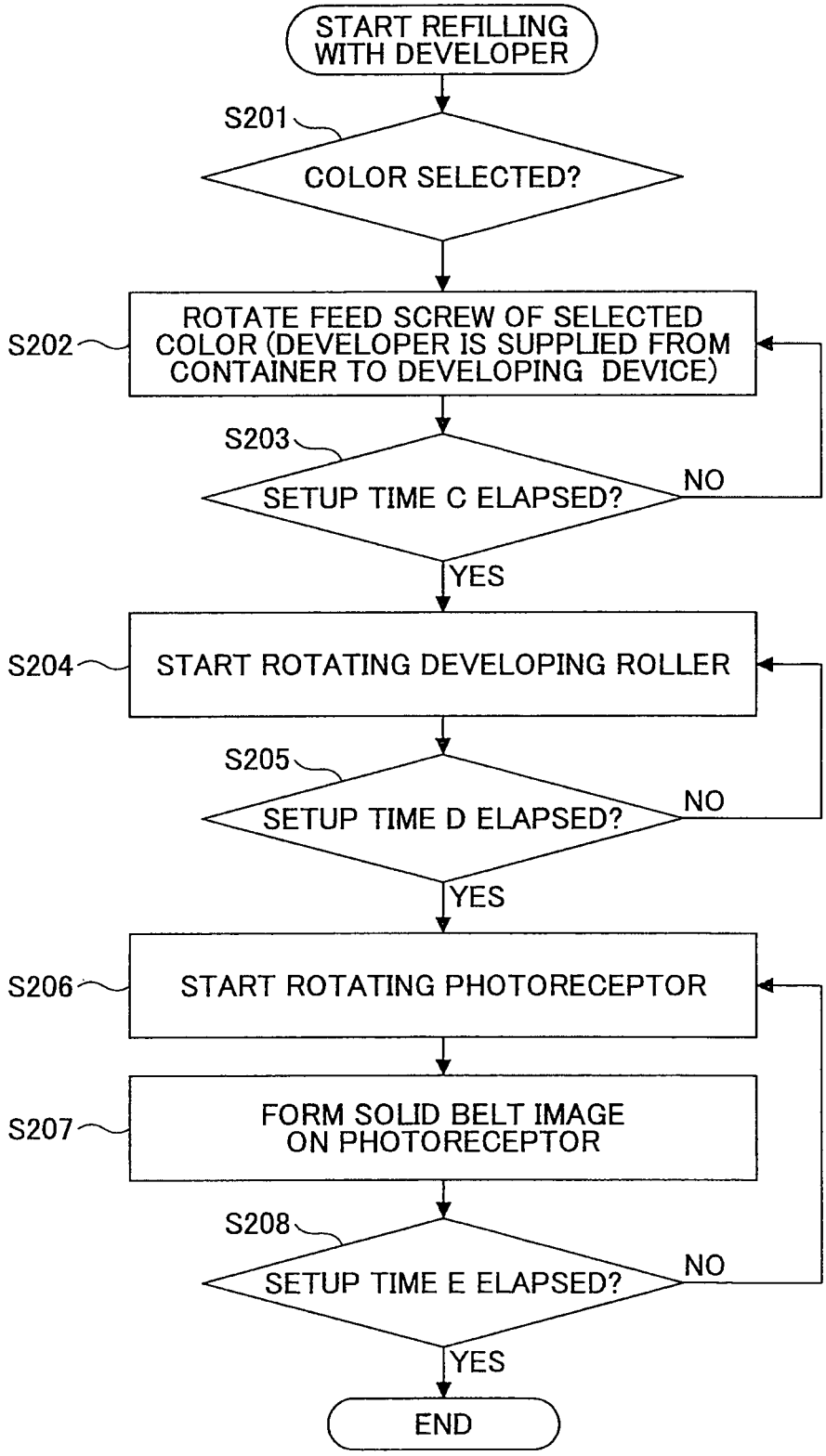
FIG. 14 is a flowchart of refilling the developing device with a developer according to the second embodiment.

FIG. 14 is a flowchart of the refill operation performed in the image forming apparatus of Example 2. Upon start of the refill operation and selection of the color (S201), the stirring feed screw 11 is driven to feed the initial developer supplied from the developer bottle 180 to the developer feed path (S202). A time required for the developer to reach the bottom end of the developer outlet port 94 is measured as a setup time in advance. When setup time C (e.g., 8 seconds) has elapsed (YES in S203), the developing roller 5 is rotated (S204). A time required to supply the developer onto the entire surface of the developing roller 5 from the beginning of the rotation of the developing roller 5, under the condition of a sufficient quantity of developer existing in the stirring feed path 10, is also measured as setup time D in advance. When setup time D (e.g., 2 seconds) has elapsed (YES in S205), the photoreceptor 1 is rotated (S206). Upon the start of the rotation of the photoreceptor 1, a toner belt (i.e., a solid belt image) is formed on the photoreceptor 1 along the longitudinal axis thereof to supply toner to the cleaning part (S207). Since at this point of time the initial developer is still remaining in the developer bottle 180, the apparatus is continuously driven. When a setup time E (e.g., 20 seconds) required to supply all the developer from the bottle, which time is measured in advance, has elapsed from the beginning of the supply of the initial developer (YES in S208), driving of all the activated components is stopped and the refill operation is finished. During the elapse of setup time E, a toner belt is again formed on the photoreceptor 1 to supply toner to the cleaning part. No malfunction, such as increase of the driving torque of the photoreceptor 1, has occurred while the photoreceptor 1 is driven.

A toner refill device (i.e., a refill unit) 600 is then fixed to this image forming apparatus, and initial developer is set up. Then a full solid image is printed. There was no adverse effect found in the printed image, which means that the refill operation was carried out without damaging the photoreceptor 1 or the cleaning blade, and without excessive discharge of the developer from the developer outlet port 94 even though the developer outlet port 94 is provided to the developing device 4.

REFERENCE EXAMPLE

A refill operation is started in the similar manner to Example 2. Unlike Example 2 in which the developing roller 5 is driven around when the level of the developer reaches the vicinity of the bottom end of the developer outlet port 94, the developing roller 5 is rotated after the setup time E (e.g., 20 seconds) required to supply all the developer from the developer bottle 180 has elapsed, as illustrated in S303 and S304 in FIG. 15. Then, after a setup time F (e.g., 2 seconds) has elapsed from the beginning of the rotation of the developing roller 5, the photoreceptor 1 is rotated (S305 and S306 in FIG. 15). A toner belt (i.e., a solid belt image) is formed on the photoreceptor 1 along the longitudinal axis thereof to supply toner to the cleaning part (S307). Then, driving of all the activated components is stopped and the refill operation is finished.

In this developing device, the discharge screw 2*a* starts operating simultaneously with the driving operation of the stirring feed screw 11, and a large quantity of initial developer is discharged out of the developing device through the developer outlet port 94 prior to the rotation of the developing roller.

A toner refill device (i.e., a refill unit) 600 is then fixed to this image forming apparatus of the Reference Example, and initial developer is set up. Then a full solid image is printed. Uneven density was found at the end of the printed image. This is because a sufficient quantity of initial developer required to cover uniformly the entire surface of the developing roller did not exist in the stirring feed path.

It is understood from this test result that in the developing device 4 having a developer outlet port 94 it is desired to control not to discharge the developer during the refill operation.

THIRD EXAMPLE

Figure 15:
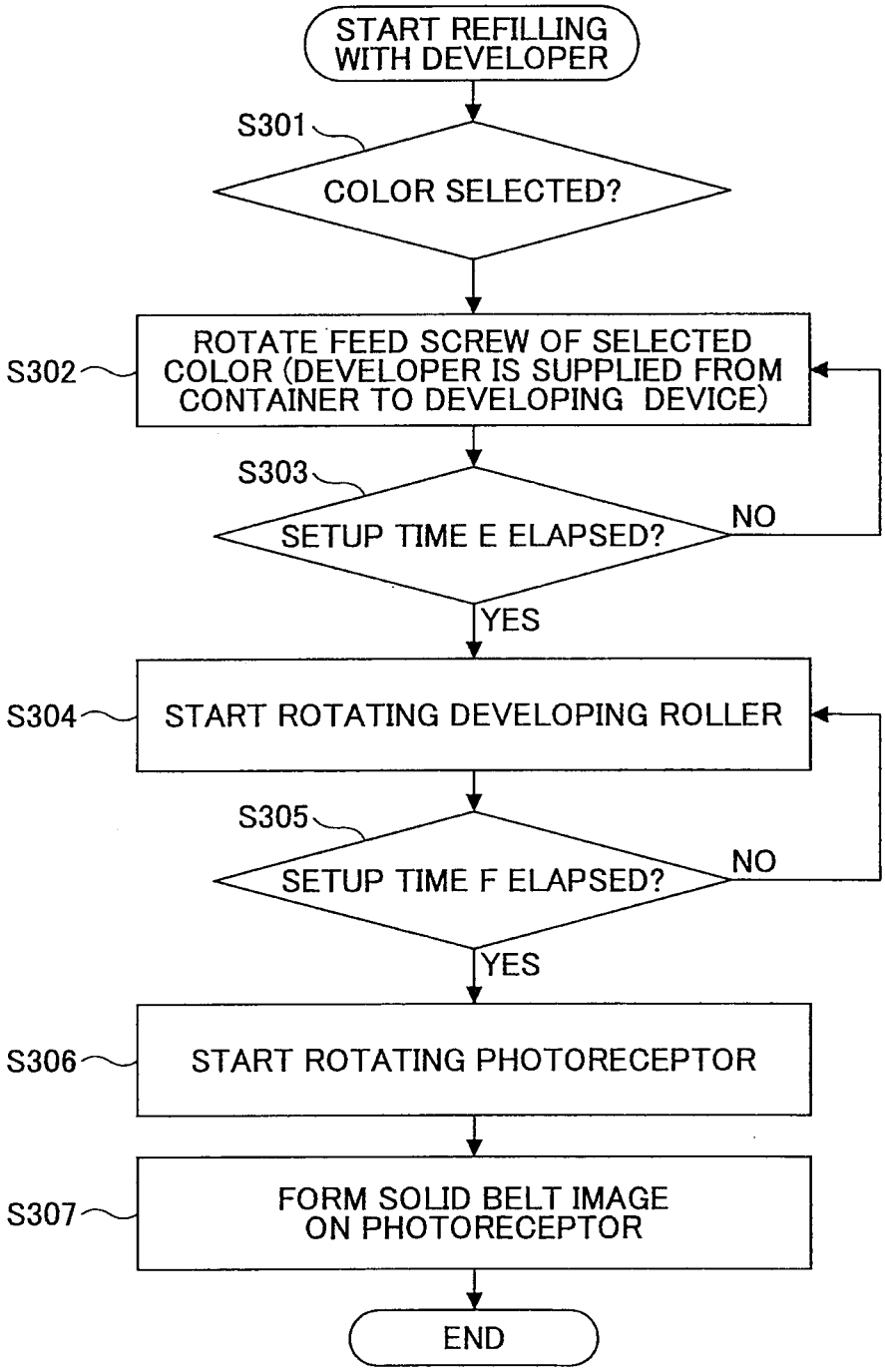
FIG. 15 is a flowchart of refilling the developing device with a developer according to the third embodiment.

According the process flow shown in FIG. 15, a refill operation is carried out in the same manner as in Reference Example. However, in Example 3, the driving operations for the stirring feed screw 11 and the discharge screw 2*a* are controlled independently, and the discharge screw 2*a* is not driven during the refill operation.

After the refill operation, a toner refill device (i.e., a refill unit) 600 is fixed to this image forming apparatus of Example 3, and initial developer is set up. Then a full solid image is printed. There was no adverse effect found in the printed image.

The reason for the clean image without causing unevenness in the density at the end of the printed image, unlike Reference Example, is that discharging of the developer through the developing outlet port 94 was restricted as much as possible. With this refill method, a time during which the photoreceptor 1 is stopped, while the developing roller 5 is driven, is shortened, and the photoreceptor 1 can be protected from damages. Furthermore, since the driving time period of the photoreceptor 1 is shortened, toner quantity supplied to the cleaning part can be reduced, while preventing the cleaning blade from bending.

FOURTH EXAMPLE

A refill operation is carried out in the same manner as in Reference Example, except that in the developing device 4 of Example 4 the discharge screw 2*a* is rotated in the reverse direction during the refill operation, opposite to that of the ordinary image forming process.

After the refill operation, a toner refill device (i.e., a refill unit) 600 is fixed to this image forming apparatus of Example 3, and initial developer is set up. Then a full solid image is printed. There was no adverse effect found in the printed image.

The reason for the clean image without causing unevenness in the density at the end of the printed image, unlike Reference Example, is that discharging of the developer through the developing outlet port 94 was restricted as much as possible by driving the discharge screw 2*a* in the reverse direction to the image forming process.

The above described modes and structures are only examples of the preferred embodiment, and there are many other modifications and substitutions within the scope of the invention defined by the attached claims. Although control means for controlling the driving members and the refill operations of initial developer are not illustrated by figures, any suitable electronic components can be selectively used as the control means. Such control means may include an initial developer filling mode for supplying initial developer into the developing device to be executed during the refill operation.

According to the first through third aspects, an initial developer can be supplied into the developing device while the developing device and the latent image carrier (photoreceptor) are inside the image forming apparatus, and it is unnecessary to take the developing device out of the image forming apparatus. The electric charge level of the initial developer is likely to decrease from the appropriate electrically charged level, depending on the time elapsed since the manufactured date or on the storage environment, and toner particles are likely to disperse or scatter. If the developer carrier (developer roller) and the latent image carrier (photoreceptor) are placed apart from each other, the scattered tonner particles are spread in the image forming apparatus. This problem is solved by the image forming apparatus of the embodiments of the present invention because the developing device and the latent image carrier are arranged in the same state as in the image forming process, and diffusion of scattered toner particles can be prevented.

Especially in the first aspect, the latent image carrier is kept non-operated even after the refilling process starts. Accordingly, the latent image carrier will not be damaged unless the developer carrier is driven. If the developing carrier and the latent image carrier are driven upon the start of the initial developer refill operation, a time required from the beginning of the rotation to uniformly supply the developer to the entire area of the developer carrier along the longitudinal axis becomes long. As a result, a time required for creating a toner belt on the entire area of the latent image carrier along the longitudinal axis thereof and a time required to supply toner to the cleaning part also become long. During the elongated period of time, the cleaning blade is likely to bend or be damaged. In contrast, by driving the developer carrier and the latent image carrier after the start of the refill operation, developer can be promptly supplied onto the entire area on the developer carrier as long as a certain quantity of developer exists in the stirring feed path. Consequently, a time required to supply a sufficient amount of toner to the cleaning part can be reduced, thereby preventing bending of or damages to the cleaning blade. In addition, by driving the developer carrier after the stirring feed member is driven, the driving time for the latent image carrier can be reduced, as compared to simultaneous driving, and a quantity of toner supplied to the cleaning part can be reduced.

According to the second aspect, the developer carrier and the latent image carrier are not driven until most of the initial developer is fed to the stirring feed path. Therefore, a time period for driving the developer carrier and the latent image carrier can be further shortened. A quantity of toner supplied to the cleaning part can also be reduced. When the developer carrier is driven under the condition that the most of the initial developer is fed to the stirring feed path, developer can be promptly supplied onto the entire area on the developer carrier. Accordingly, a toner belt can be formed promptly on the entire area of the latent image carrier along the longitudinal axis thereof. This arrangement can substantially eliminate an undesired situation where the latent image carrier is driven without or with little toner supplied to the cleaning part.

According to the third aspect, the developer carrier is driven before the latent image carrier. The latent image carrier is driven after the developer has been supplied to the entire area on the developer carrier. Toner can be supplied to the cleaning part in a reliable manner, as compare to simultaneous driving.

According to the fourth aspect, a surplus developer outlet port is provided to the developing device for discharging an excessive quantity of developer depending on the level of the developer, without external control. New developer is supplied in place of the discharged developer, and the workload for replacing the developer can be reduced. With this developing device, the level of the top surface of the developer in the stirring feed path is slightly higher by an amount corresponding to a quantity supplied onto the developer carrier, before the developer carrier is driven to receive developer. The initial developer may be discharged excessively unless the developer is supplied onto the developer carrier before the level of the developer exceeds the bottom end of the surplus developer outlet port. If in this state the developer carrier is driven to allow the developer to be supplied to the developer carrier, the developer may not be uniformly supplied onto the developer carrier due to shortage of the developer in the stirring feed path. This may result in defects, such as uneven density, in the subsequent image formation process. To overcome this problem, in the embodiments of this invention, the refill process is controlled so as not to discharge the developer during the refill operation. This arrangement can prevent a large quantity of developer from being discharged before the developer carrier is driven (in which state the level of the developer is likely to be elevated), and prevent shortage of developer supplied during the image formation process.

According to the fifth aspect, the discharge feed member of the discharge feed path is not driven. With this arrangement, a small quantity of developer may be discharged from the feed path, but the discharged developer stays at the outlet port and blocks the port. This arrangement can prevent a large quantity of developer from being discharged without using an extra component.

According to the sixth aspect, the discharge feed member of the discharge feed path is driven in a reverse direction to that in the image formation process. With this arrangement, a small quantity of developer may be discharged from the feed path, but the discharged developer stays at the outlet port and blocks the port. This arrangement can prevent a large quantity of developer from being discharged without using an extra component.

According to the seventh aspect, a developing device suitably used in the above-described image forming apparatus can be provided.

This international patent application claims the benefit of the earlier filing date of Japanese Priority Application No. 2010-027138 filed on Feb. 10, 2010, the entire contents of which are incorporated herein by reference.

The invention claimed is:

1. An image forming apparatus comprising:

a developing device including:

a developer feed path, a stirring feed path, a stirring feed member that stirs a developer in the stirring feed path to feed the developer into the developer feed path, a developer carrier, and a supply port for supplying the developer;

a latent image carrier positioned so as to face the developer carrier; and a control unit configured to control a refill operation for refilling the developing device with an initial developer, while maintaining the developing device and the latent image carrier inside the image forming apparatus in a same state as in an image forming process, wherein when refilling the developing device with the initial developer, the control unit first drives the stirring feed member to feed the initial developer from the supply port into the stirring feed path before being fed into the developer feed path of the developing device, and then drives the developer carrier and the latent image carrier to supply the initial developer onto the developer carrier.

2. The image forming apparatus according to claim 1, wherein the control unit controls the refill operation such that the feeding of the initial developer into the developing device is finished before the developer carrier and the latent image carrier are driven.

3. The image forming apparatus according to claim 1, wherein the latent image carrier is driven after the developer carrier is driven.

4. The image forming apparatus according to claim 1, wherein the developing device further has a surplus developer outlet port for discharging an excessive quantity of the developer from the developer feed path depending on a level of the developer in the developer feed path, and wherein the control unit controls the refill operation so as not to discharge the initial developer during the refill operation.

5. The image forming apparatus according to claim 4, wherein the developing device further has a discharge feed path for transferring discharged developer out of the developing device and a discharge feed member, and wherein the control unit does not drive the discharge feed member during the refill operation.

6. The image forming apparatus according to claim 4, wherein the developing device further has a discharge feed path for transferring discharged developer out of the developing device and a discharge feed member, and wherein the control unit drives the discharge feed member in a direction opposite to a direction of the image forming process.

7. The image forming apparatus according to claim 1, wherein the developing device includes a surplus developer outlet port for discharging an excessive quantity of developer depending on a level of the developer in the developer feed path.

8. The image forming apparatus according to claim 1, wherein the supply port is provided above the stirring feed path, and adjacent to the developer feed path along a longitudinal axis of the developing device.

9. The image forming apparatus according to claim 1, wherein the developing device further includes a toner concentration sensor, and wherein the control unit drives the developer carrier after driving the stirring feed member when the toner concentration sensor detects a toner concentration of the initial developer has reached a predetermined toner concentration.

10. The image forming apparatus according to claim 1, wherein the image forming apparatus further includes a timer, and wherein the control unit drives the developer carrier after driving the stirring feed member when the timer counts a predetermined time from a start of the refill operation.

11. The image forming apparatus according to claim 1, wherein rotation of the developer carrier is started after the initial developer is supplied into the developing device with the supply port and during the supply of the initial developer onto the developer carrier.

12. The image forming apparatus according to claim 1, wherein the supply port is located along a longitudinal axis of the developing device entirely outside of a width of the developer carrier that extends along the longitudinal axis.

13. An image forming apparatus comprising:

a developing device including:

a developer feed path, a stirring feed member for stirring and feeding a developer in the developer feed path, a developer carrier, and a surplus developer outlet port for discharging an excessive quantity of the developer from the developer feed path depending on a level of the developer in the developer feed path;

a latent image carrier positioned so as to face the developer carrier, and a control unit configured to control a refill operation for refilling the developing device with an initial developer, while maintaining the developing device and the latent image carrier inside the image forming apparatus in a same state as in an image forming process, wherein when refilling the developing device with the initial developer, the control unit first drives the stirring feed member to feed the initial developer into the developing device, and then drives the developer carrier and the latent image carrier to supply the initial developer onto the developer carrier, and wherein the control unit controls the refill operation so as not to discharge the initial developer during the refill operation.

14. The image forming apparatus according to claim 13, wherein the developing device further has a discharge feed path for transferring discharged developer out of the developing device and a discharge feed member, and wherein the control unit does not drive the discharge feed member during the refill operation.

15. The image forming apparatus according to claim 13, wherein the developing device further has a discharge feed path for transferring discharged developer out of the developing device and a discharge feed member, and wherein the control unit drives the discharge feed member in a direction opposite to a direction during the image forming process.

* * * * *